United States Patent [19]

Van Veldhoven

[11] 4,013,231

[45] Mar. 22, 1977

[54] AEROSOL CAN NOZZLE AND CAP ASSEMBLY

[76] Inventor: George E. Van Veldhoven, 13934 Yukon Ave., Hawthorne, Calif. 90250

[22] Filed: Oct. 17, 1974

[21] Appl. No.: 515,565

[52] U.S. Cl. ..... 239/579; 222/402.11; 222/402.15; 239/600

[51] Int. Cl.[2] ..... B65D 83/14

[58] Field of Search ..... 239/274, 573, 577, 579, 239/600; 222/402.11, 402.13, 402.14, 402.15, 174, 509

[56] References Cited

UNITED STATES PATENTS

| | | | |
|---|---|---|---|
| 2,953,283 | 9/1960 | Palkowski | 222/402.15 |
| 3,109,565 | 11/1963 | Kutik | 222/402.15 X |
| 3,138,331 | 6/1964 | Kutik | 222/402.13 X |
| 3,149,761 | 9/1964 | Harris et al. | 222/402.15 X |
| 3,185,349 | 5/1965 | Sagarin | 222/402.13 X |
| 3,450,313 | 6/1969 | Jonas | 222/402.13 |
| 3,642,179 | 2/1972 | Micallef | 222/402.13 X |
| 3,809,319 | 5/1974 | Kimura | 239/274 |

*Primary Examiner*—Evon C. Blunk
*Assistant Examiner*—Michael Mar

[57] ABSTRACT

A readily cleanable nozzle and cap member for use on aerosol cans. The nozzle portion of the cap member is hinged to the cap which permits the nozzle to be swung away from the cap for cleaning. A latch interconnects the nozzle with the cap and holds the nozzle in a generally closed position when in its closed position. The latch permits further downward movement of the nozzle assembly to actuate the aerosol spray.

2 Claims, 8 Drawing Figures

AEROSOL CAN NOZZLE AND CAP ASSEMBLY

BACKGROUND OF THE INVENTION

The field of the invention is spray nozzles for aerosol cans such as paint cans. The invention more particularly relates to readily cleanable nozzles.

Aerosol cans are widely used to spray a wide variety of substances such as paint, lacquer, whipped cream, and other materials which tend to dry, harden or deteriorate after spraying. Spray nozzles, if not properly cleaned, become either partially or completely clogged and cause the spray to become uneven or completely stopped. If the substance sprayed can be attacked by bacteria, the nozzle can become a location where spoilage can take place which can lead to clogging or an undesirable odor. While it is common practice to invert some types of aerosol cans such as spray paint cans in order to discharge the paint from the feed tube and from the nozzle, such procedure is not completely effective to prevent clogging. Other types of cans such as whipped cream cans are not readily cleaned in this manner. Furthermore, cleaning by inversion and expelling results in a certain amount of paint residue left in the nozzle and an improved and simplified cleaning method is needed. While most nozzles can be unplugged from the spray can and immersed in solvent, such procedures are cumbersome and the replacement of the nozzle on the can often results in the spraying of additional amounts of paint which again clog the nozzle.

SUMMARY OF THE INVENTION

The present invention is for a readily cleanable nozzle and cap member for use on aerosol cans such as spray paint cans. The nozzle and cap member has a cylindrical skirt adapted to fit over the spray end portion of an aerosol can and a side wall extends upwardly from the skirt in a manner similar to that used on most aerosol can caps today. The side wall of the present invention curves inwardly to form a top wall and has hinge means to which a nozzle assembly is connected. The nozzle assembly is supported by the hinge means and positioned to permit the nozzle assembly to protrude away from the outer surface of the rest of the cap so that when the nozzle is in an open position it can be readily immersed in a solvent or other cleaning solution. The nozzle assembly further has latching means which connects the side wall and the nozzle assembly and holds the nozzle assembly in a generally closed position when it is not in its open or cleanable position. The latching means is adapted to permit the nozzle assembly to be depressed, thereby opening the valve within the aerosol can and released to close the valve while still holding the nozzle in a generally closed position. A preferred latching means comprises an opening in the top wall which cooperates with one or more fingers affixed to the nozzle assembly. The nozzle assembly may further be readily adapted to permit operation of the spray can from a remote location by pulling down on a string or other member attached to the outermost extremity of the nozzle assembly.

DESCRIPTION OF THE PREFERRED EMBODIMENTS

Figure 1:
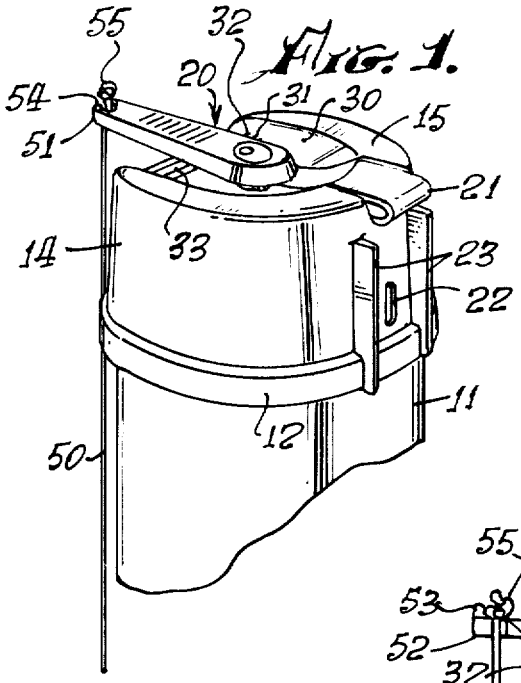
FIG. 1 is a perspective view of the nozzle and cap assembly of the present invention.

A cap and nozzle assembly is shown in FIG. 1 and indicated generally by reference character 10. The assembly is mounted on an aerosol can 11 by means of a cylindrical skirt 12 which fits over the upper rim of the can 13 in a conventional manner shown most clearly in FIG. 3.

A side wall 14 extends upwardly from skirt 12 and terminates in a top portion 15. The nozzle assembly indicated generally by the reference character 20 is hinged to side wall 14 by an integrally formed hinge 21. The cap may also contain means for suspending the can on a screw, nail or the like and such means are shown on cap 10 comprising a slotted opening 22 and a pair of support rails 23.

Figure 2:
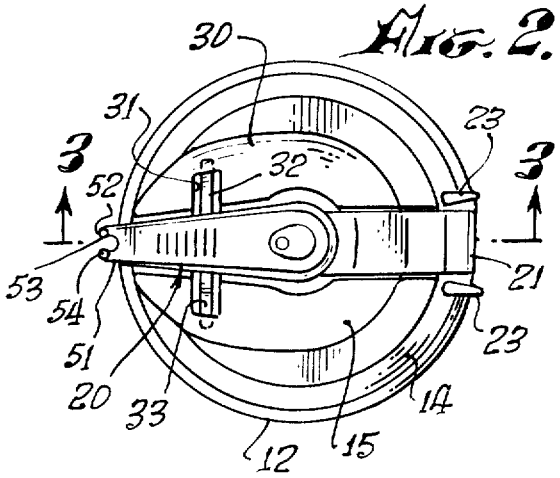
FIG. 2 is a plan view of the assembly of FIG. 1.

A plan view of cap 10 is shown in FIG. 2 which more clearly depicts the latching means which holds the nozzle assembly 20 in a generally closed positon. Top 15 of cap 10 has a downwardly extending inner wall 30 which contains a slotted opening 31 formed therein. A pair of arms or fingers 32 and 33 are integrally formed with the nozzle assembly and located at a right angle with the longitudinal axis of the nozzle assembly. Arms 32 and 33 are flexible and their outer ends extend past the upper surface of opening 31 to hold the nozzle assembly in a generally closed position. With sufficient force, however, the arms will flex and permit the nozzle assembly to be opened to a position similar to that shown in FIG. 6 of the drawings.

Figure 3:
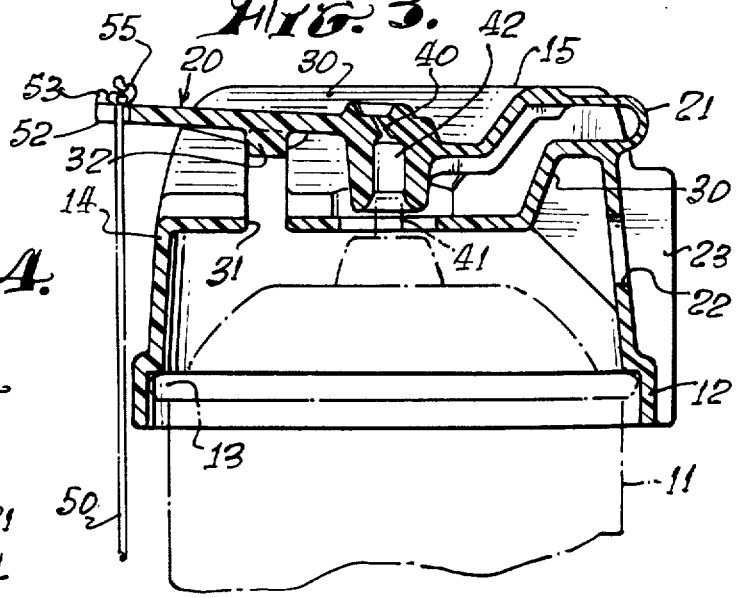
FIG. 3 is a cross sectional view taken along line 3—3 of FIG. 2.

Further detail of the latching means is shown in enlarged view in FIG. 3 where opening 31 is shown to extend completely across the inner wall 30 and the base portion 35 of the inner wall 30.

The nozzle details are also shown in FIG. 3 where the outlet 40 conveys the contents from tube 41 of can 11 through chamber 42 of the nozzle assembly.

Figure 4:
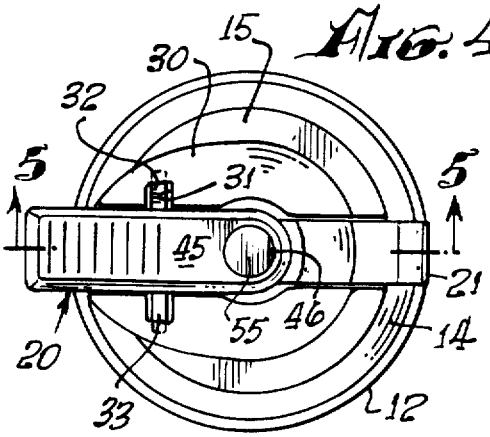
FIG. 4 is a plan view of a modified form of the cap assembly of the present invention.
Figure 5:
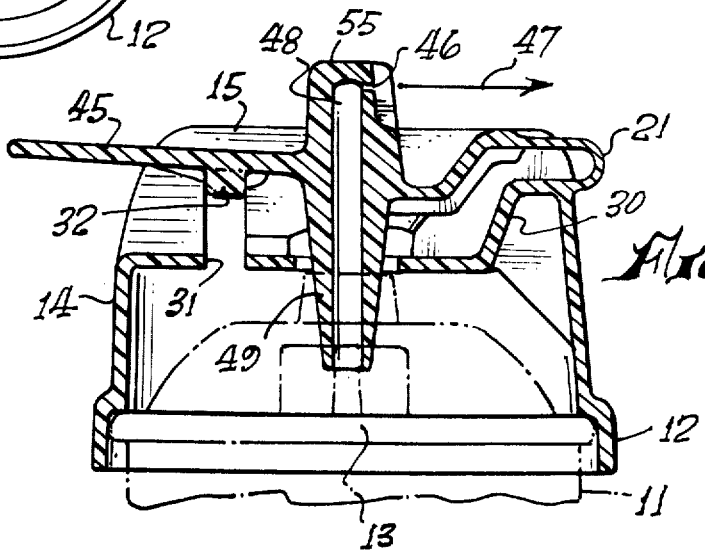
FIG. 5 is a cross sectional view taken along line 5—5 of FIG. 4.

A modified form of the nozzle assembly is shown in plan view in FIG. 4 where a flattened actuating lever 45 facilitates the operation of the nozzle assembly by thumb or finger pressure. The nozzle assembly of the cap shown in FIGS. 4 and 5 is modified to cause the contents of the can to be sprayed in a direction away from the actuating arm as shown most clearly in FIG. 5. Outlet 46 causes the contents to be sprayed in a direction indicated by arrow 47. The contents of the can are conducted through chamber 48. The lower extension 49 of the nozzle assembly should be adapted to mate with the valve means of the particular aerosol can used. The configuration of the lower extension is of a generally conventional shape and depends upon particular design of the valve used which varies with different cans. It is not believed that an explanation of any particular configuration is necessary for an understanding of the present invention.

For use in spray paint it is common to use an exit nozzle insert and the nozzle assembly of the present invention can readily be adapted for the use of such inserts. The aerosol can is, of course, operated by depressing lever 45 or by pulling downwardly on string 50 shown in FIG. 3.

String 50 may be attached to the nozzle assembly 20 in a manner shown most clearly in FIG. 2. A pair of arms 51 and 52 cooperate with a pair of knobs 53 and 54 to encircle a knot 55 formed at the end of string 50. Other attachment means may also be used in place of that shown in FIGS. 1 through 3.

An important feature of the present invention is the nozzle assembly's ease of cleaning. When the nozzle is used for products such as paint or foodstuffs which tend to dry and clog the nozzle, the nozzle may be swung open in a manner such as that shown in FIG. 6 and readily immersed in a cleaning solution or solvent for the particular material sprayed. It is common to clear a paint spray can nozzle by inverting the can and expelling the paint from the tube and nozzle. Such procedures are not completely effective, however, to clean the nozzle, and after the normal expelling step the nozzle may be immersed in a solvent to remove the last traces of paint. Thus, after the expelling step, it is beneficial to remove the last traces of paint from the nozzle and the present invention is designed to facilitate this step.

Figure 6:
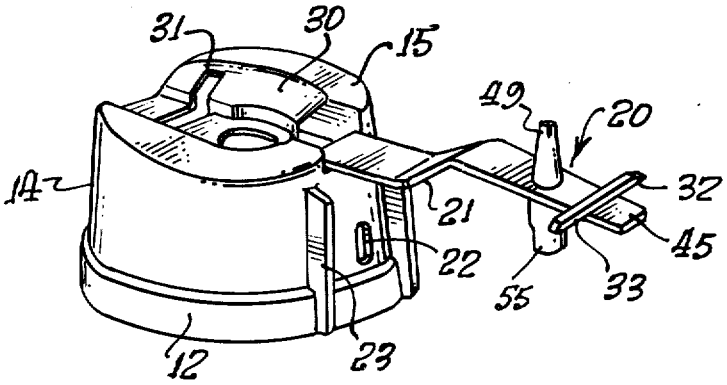
FIG. 6 is a perspective view of a modified form of the cap of the present invention.

As shown in FIG. 6, the nozzle assembly 20 is depicted in an open position and the lower extension of the nozzle assembly 49 as well as the upper extension 55 is readily available for immersion in a solvent. The under side of arms 32 and 33 are visible in FIG. 6 and, as above described, these snap into opening 31 to hold the nozzle assembly 20 in a generally closed position.

Figure 7:
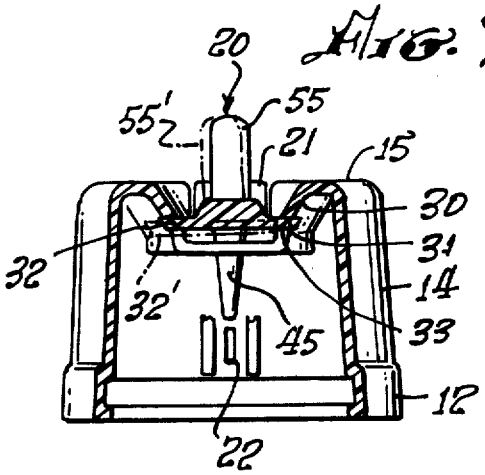
FIG. 7 is a cross sectional side elevation of the cap and nozzle assembly of FIG. 6.

While the device of the present invention may rely entirely on the flexibility of arms 32 and 33 to gain entrance into the opening 31 the device is preferably fabricated in a manner to permit some lateral movement of assembly 20 in order to prolong the life of the arms 32 and 33 as well as to enable the arms to be made longer without fear of breakage. The phantom lines such as those located at 55' and 32' indicate the lateral movement. As shown in FIG. 7, arm 33 may be released from opening 31 by movement of the nozzle assembly20 to the phantom line position. Such lateral movement is not as important for the insertion of arms 32 and 33 since the inner wall 30 may be fabricated from a plastic having some flexibility which may be slightly deformed when the assembly is pushed downwardly into the closed position on the cap. It would also be possible to fabricate arms 32 and 33 from a rigid material and rely entirely upon the flexibility of the inner wall 30 although the combined flexibility of the two members is preferred.

Figure 8:
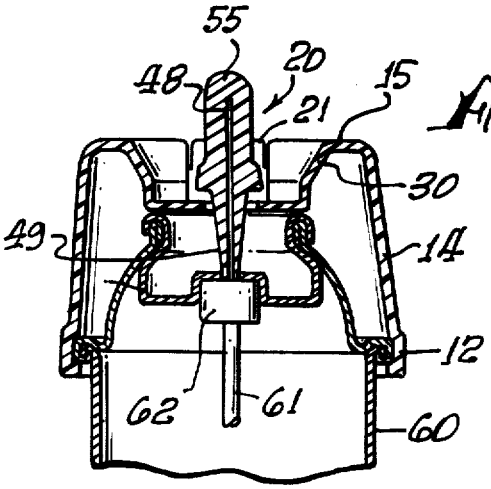
FIG. 8 is a side elevation partly in cross section of the cap of FIG. 7 mounted on an aerosol can.

The device is shown in FIG. 8 assembled onto an aerosol can 60 of the type commonly used for relatively high pressure applications such as spray paint. The can and valve are of a conventional type and have a siphon tube 61 and a valve actuation assembly 62 again of conventional design. In operation, the cap, preferably having the nozzle assembly in an open position, is inserted over the rim of can 60. The nozzle assembly is then placed in its generally closed position with the lower extension 49 contacting the valve actuating member 62. When the nozzle assembly 20 is further depressed, the valve in can 60 is opened causing paint or other contents to be expelled through chamber 48 and the exit nozzle thereof. It is, of course, not necessary to remove the cap portion of the assembly from the can when cleaning is desired as the nozzle assembly may be merely opened in a manner shown in FIG. 6 with the remaining portion of the cap maintained over can 60.

The nozzle and cap member of the present invention may be fabricated from conventional materials and are preferably injection molded utilizing a thermoplastic polymer. The polymer should, if used for paint, be resistent to the solvent commonly contained in the paint as well as paint thinner and other solvents likely to be used for cleaning by the purchaser. While the latching device in the drawings is shown with a pair of arms, a single arm could also be used as could more than 2 arms. Furthermore, while the arms are shown located between the actuating end of the nozzle assembly and the nozzle itself, they could alternatively be placed between the nozzle and the hinge and still perform their desired function. Still further, the arms could be positioned on the cap assembly rather than on the nozzle assembly.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A readily cleanable nozzle and cap member for use on aerosol cans, said member comprising:

a cylindrical skirt adapted to fit over the spray end portion of an aerosol can;

a side wall affixed to said skirt and extending upwardly therefrom, said side wall curving inwardly to form a top wall;

hinge means connected to said side wall comprising a loop of flexible plastic;

a nozzle assembly supported by said hinge means and positioned to permit said nozzle assembly to swing at least 90° from its closed position to permit the nozzle to be positioned in an open position which is away from the outer surface of the rest of the cap and further positioned to cause at least a portion of said nozzle assembly to protrude below the top of said cylindrical wall when said hinge is in a closed position and to cause the lower extremity of said nozzle assembly to abut valve means on the spray end of an aerosol can; a flattened extension located on the opposite end of said nozzle assembly from the hinge means end thereof disconnectable latching means interconnecting said side wall and said nozzle assembly to cause said nozzle assembly hinge to remain in a generally closed position when said latching means is in a closed configuration, said latching means comprising a pair of flexible aligned fingers positioned on said flattened extension at a right angle with respect to the axis of said flattened extension and said top wall has at least one opening having a pair of upper stops positioned so that the spacing between the uppermost termination of said stops are closer together than the distance between the tips of said fingers but positioned far enough apart to permit the nozzle assembly and its aligned fingers to be repeatedly pulled upwardly out of said side wall without damage to said aligned fingers.

2. The member of claim 1 wherein said hinge means permits said nozzle assembly to be deflected laterally in a first direction an extent sufficient to permit one of said fingers to be freely released from said opening and in an opposite direction an extent sufficient to permit the other of said fingers to be freely released from said opening.

* * * * *